US010837473B2

(12) United States Patent
Kawabuchi et al.

(10) Patent No.: US 10,837,473 B2
(45) Date of Patent: Nov. 17, 2020

(54) HYDRAULIC SYSTEM

(71) Applicant: TADANO LTD., Kagawa (JP)

(72) Inventors: Naoto Kawabuchi, Kagawa (JP); Naofumi Yoshida, Kagawa (JP); Naotaka Masuda, Kagawa (JP); Yasuhiro Fukumori, Kagawa (JP)

(73) Assignee: TADANO LTD., Kagawa (JP)

( * ) Notice: Subject to any disclaimer, the term of this patent is extended or adjusted under 35 U.S.C. 154(b) by 0 days.

(21) Appl. No.: 16/085,797

(22) PCT Filed: Mar. 24, 2017

(86) PCT No.: PCT/JP2017/012021

§ 371 (c)(1),
(2) Date: Sep. 17, 2018

(87) PCT Pub. No.: WO2017/164371

PCT Pub. Date: Sep. 28, 2017

(65) Prior Publication Data

US 2019/0085876 A1 Mar. 21, 2019

(30) Foreign Application Priority Data

Mar. 24, 2016 (JP) ..... 2016-060951

(51) Int. Cl.
*F15B 13/043* (2006.01)
*F15B 20/00* (2006.01)

(52) U.S. Cl.
CPC ..... *F15B 20/002* (2013.01); *F15B 13/043* (2013.01)

(58) Field of Classification Search
CPC ..... F15B 13/043; F15B 20/002; F15B 2211/8626; F15B 2211/8753; F15B 2211/8755; F15B 2211/8752
See application file for complete search history.

(56) References Cited

U.S. PATENT DOCUMENTS 4,072,169 A * 2/1978 Heiser ..... F15B 13/043 137/596.13
7,207,353 B2 * 4/2007 Bogdanowicz ..... F15B 13/0402 137/625.64
2010/0313556 A1 12/2010 Kim

FOREIGN PATENT DOCUMENTS

CN 101922489 A 12/2010
JP 2000-344466 A 12/2000
JP 2009-263061 A 11/2009

OTHER PUBLICATIONS

Jun. 6, 2017, International Search Report issued for related PCT application No. PCT/JP2017/012021.

(Continued)

*Primary Examiner* — F Daniel Lopez
(74) *Attorney, Agent, or Firm* — Paratus Law Group, PLLC

(57) ABSTRACT

This hydraulic system is provided with a hydraulic pump, a control valve, and a pilot pressure supply unit. The pilot pressure supply unit has: an electromagnetic proportional valve that has a detent-type emergency manual operation function with which a pilot oil passage can be opened manually and generates pilot pressure for a control valve; a controller that controls the degree of opening of the electromagnetic proportional valve in accordance with the operation of an operation lever; and a pilot pressure switching unit that switches the oil pressure state of the pilot pressure supply unit between an on-loading state and an unloading state. The pilot pressure switching unit performs control to implement the unloading state when the electromagnetic proportional valve is being opened manually and performs control to implement the on-loading state after the electromagnetic proportional valve has been opened manually.

5 Claims, 6 Drawing Sheets

(56) References Cited

OTHER PUBLICATIONS

Jun. 6, 2017, International Search Opinion issued for related PCT application No. PCT/JP2017/012021.
Oct. 22, 2019, European Search Report issued for related EP Application No. 17770411.1.

* cited by examiner

--Prior Art--

HYDRAULIC SYSTEM

CROSS REFERENCE TO PRIOR APPLICATION

This application is a National Stage Patent Application of PCT International Patent Application No. PCT/JP2017/012021 (filed on Mar. 24, 2017) under 35 U.S.C. § 371, which claims priority to Japanese Patent Application No. 2016-060951 (filed on Mar. 24, 2016), which are all hereby incorporated by reference in their entirety.

TECHNICAL FIELD

The present invention relates to a hydraulic system of a working machine, and particularly to a hydraulic system including an electric operation system for electrically controlling a control valve of the hydraulic system.

BACKGROUND ART

In recent years, for an operation system of a hydraulic working machine, an electric operation system for electrically controlling a control valve of a hydraulic system has been used. In the electric operation system, an electric signal from an operation lever is input to a controller, and an electromagnetic proportional valve operates according to the electric signal from the controller. By the operation of the electromagnetic proportional valve, a pilot pressure of the control valve of the hydraulic system is controlled.

The electric operation system can be subjected to advanced control by causing a controller to execute control logic and is becoming an important technique for responding to a high demand such as energy saving, low noise, or optimum control for a hydraulic working machine in recent years.

In the electric operation system, when an electric circuit portion has failed, a controller cannot control an electromagnetic proportional valve. Therefore, the electric operation system preferably includes an emergency operation device for dealing with a failure (for example, Patent Literature 1). FIG. 6 illustrates an example of the electric operation system including the emergency operation device.

In the electric operation system illustrated in FIG. 6, in a normal state, when an operation lever 9 of an operation box 20 is operated, a drive electric signal based on the operation is output from a controller 2, and input to an electromagnetic proportional valve 4 via an amplifier 3. A pilot pressure is controlled by an operation of the electromagnetic proportional valve 4, a control valve 27 is switched, and an actuator 5 is thereby driven.

When a failure such as disconnection occurs in an electric circuit portion of the electric operation system, a power source changeover switch 22 is switched to an emergency operation side. An emergency operation switch 21 built in the operation box 20 is switched in conjunction with the operation of the operation lever 9, one of the electromagnetic proportional valves 4 is energized, and a pilot pressure is thereby supplied to the control valve 27 to drive the actuator 5.

By the way, the emergency operation device illustrated in FIG. 6 can deal with a case where the electromagnetic proportional valve 4 cannot be controlled due to a failure of an electric circuit portion, but cannot deal with a case where adhesion due to disconnection or contamination occurs and the electromagnetic proportional valve 4 itself does not function.

For such a failure of an electromagnetic proportional valve itself, the electromagnetic proportional valve has an emergency manual operation function. In this case, an operator directly activates an emergency manual operation function of an electromagnetic proportional valve to be operated, opens an oil passage of the electromagnetic proportional valve, and thereby can supply a desired pilot pressure to a control valve to drive an actuator.

The electromagnetic proportional valve with an emergency manual operation function includes a detent-type valve and a momentary type valve. An electromagnetic proportional valve that can be fixed in a state where a flow path thereof is opened is referred to as a detent-type valve, and an electromagnetic proportional valve that cannot be fixed in the opening state is referred to as a momentary type valve. For example, an emergency operation screw is used in the detent-type valve, and a push pin (pin biased in a direction opposite to a pushing direction) is used in the momentary type valve.

CITATION LIST

Patent Literature

Patent Literature 1: JP 2000-344466 A

SUMMARY OF THE INVENTION

Problems to be Solved by the Invention

Normally, an electromagnetic proportional valve is disposed on a frame of a working machine outside a cab of the working machine. During work with the working machine, a pilot circuit including the electromagnetic proportional valve is in an on-loading state (a state where a pilot oil pressure is applied). In a case of using an emergency manual operation function of the electromagnetic proportional valve, an operator performs work outside the cab. Furthermore, at the same time as performing an operation to directly open an oil passage of the electromagnetic proportional valve, a pilot pressure is supplied to a control valve, and an actuator starts to operate. Therefore, this is very dangerous.

An object of the present invention is to provide a hydraulic system with which an operator can safely perform work during an emergency operation even in a case where an electromagnetic proportional valve itself has failed.

Solutions to Problems

The hydraulic system according to the present invention includes: a hydraulic pump; a control valve for supplying an operating pressure from the hydraulic pump to an actuator of a working machine; and a pilot pressure supply unit for supplying a pilot pressure for the control valve, and is characterized in that the pilot pressure supply unit includes:

an electromagnetic proportional valve that has a detent-type emergency manual operation function capable of manually opening a pilot oil passage and generates a pilot pressure to the control valve;

a controller for controlling the degree of opening of the electromagnetic proportional valve in accordance with an operation of an operation lever; and a pilot pressure switching unit for switching the pilot pressure supply unit between an on-loading state and an unloading state, and the pilot pressure switching unit controls a pilot pressure such that the pilot pressure is in the unloading state when the electromagnetic proportional valve is manually opened, and controls the pilot pressure such that the pilot pressure is in the on-loading state after the electromagnetic proportional valve is manually opened.

Effects of the Invention

With the hydraulic system according to the present invention, an operator can safely perform work during an emergency operation even in a case where an electromagnetic proportional valve itself has failed.

DESCRIPTION OF EMBODIMENTS

Figure 1:
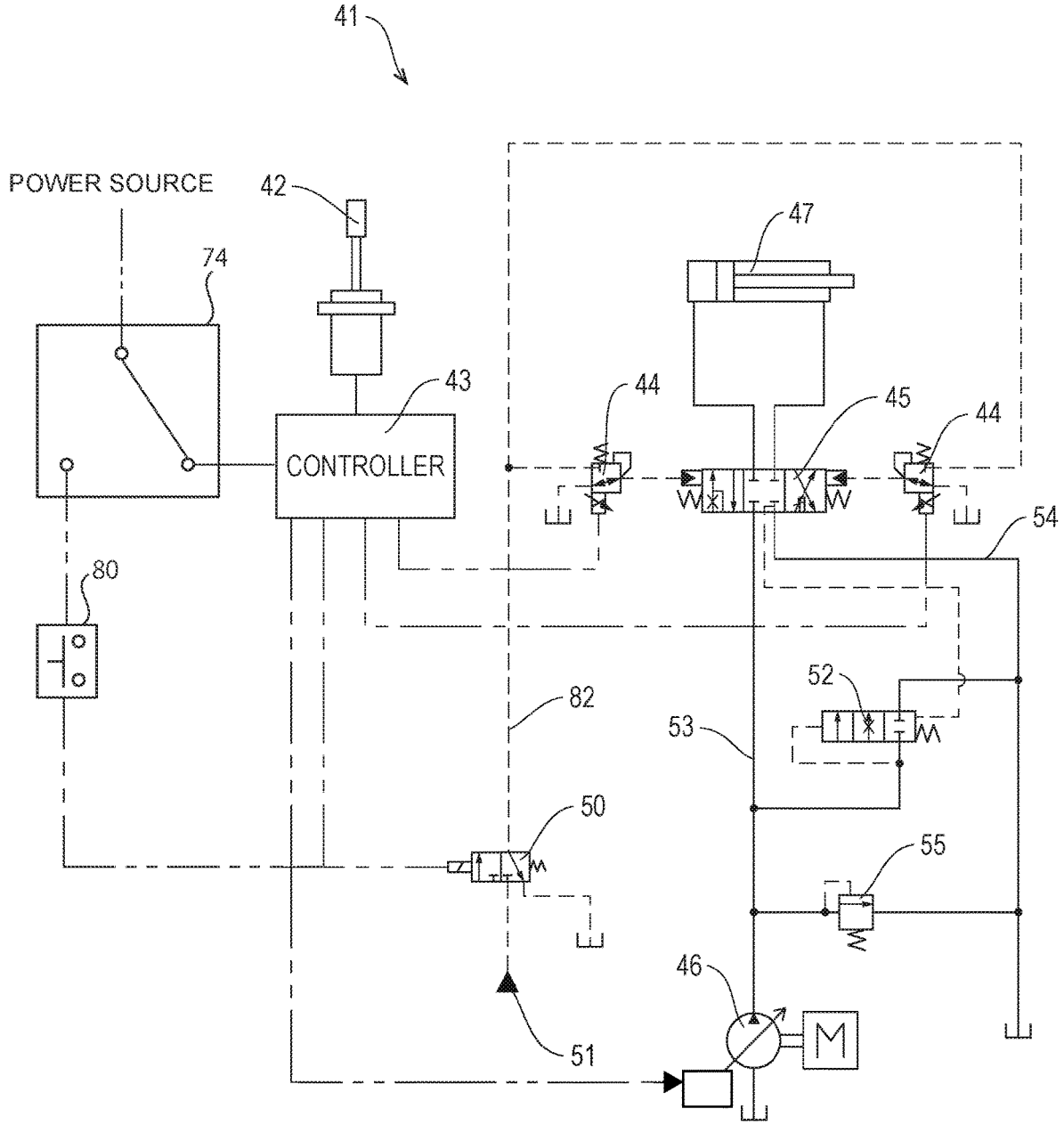
FIG. 1 is a diagram illustrating an example of a hydraulic circuit in a normal state of a hydraulic system according to an embodiment of the present invention.

FIG. 1 is a diagram illustrating a hydraulic circuit in a normal state of a hydraulic system 41 according to an embodiment of the present invention.

Figure 5:
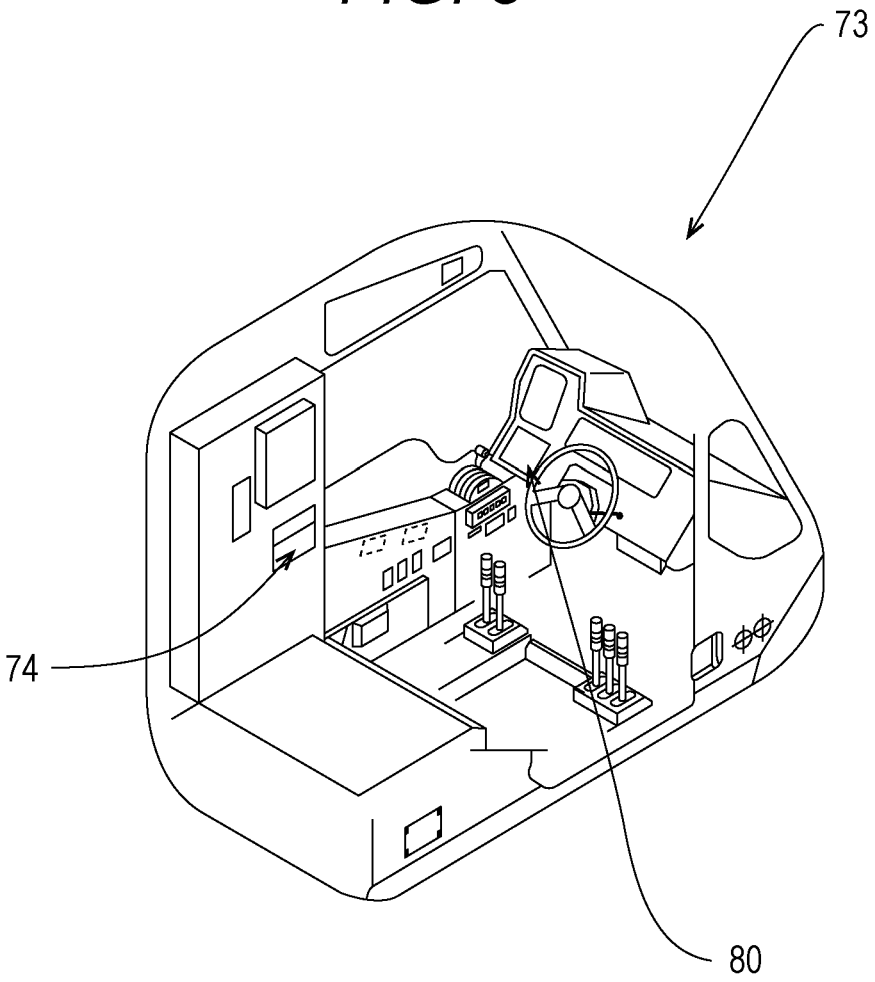
FIG. 5 is a diagram illustrating an example of an emergency operation activation switch disposed in a cab.
Figure 6:
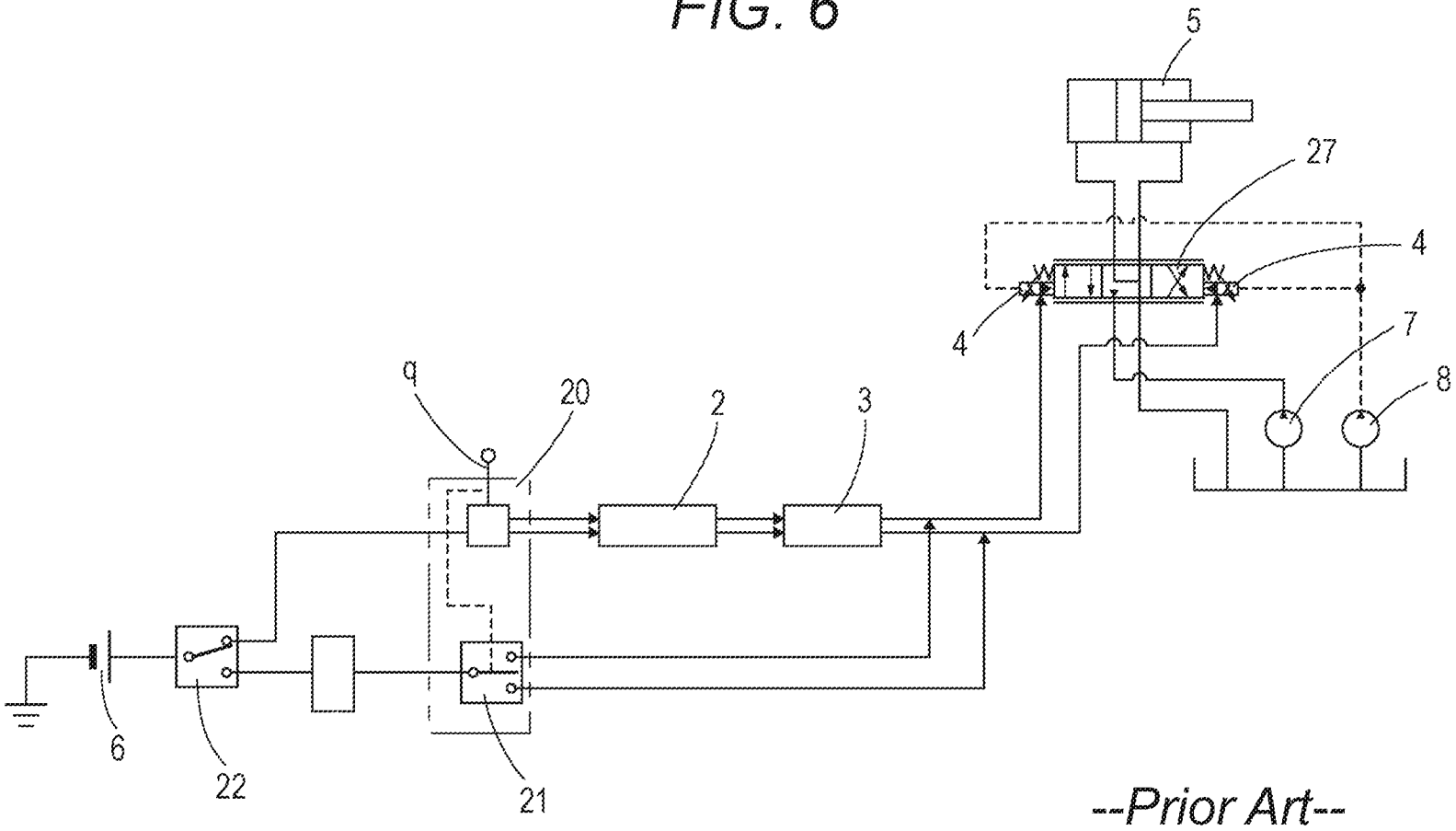
FIG. 6 is a diagram illustrating a circuit of an emergency operation device disclosed in Patent Literature 1.

The hydraulic system 41 includes a main circuit for supplying an operating pressure to an actuator 47 and a pilot circuit for operating the main circuit. The main circuit includes a hydraulic pump 46, a motor 48, a control valve 45, a pressure-compensated flow regulating valve 52, and a relief valve 55. The pilot circuit includes an operation lever 42, a controller 43, an electromagnetic proportional valve 44, a pilot pressure unloading solenoid valve 50, and an emergency operation activation switch 80 (see FIGS. 3 and 5). That is, an electric operation system is applied to the pilot circuit.

In the hydraulic system 41, the pilot circuit constitutes a pilot pressure supply unit for supplying a pilot pressure to the control valve 45. The pilot pressure unloading solenoid valve 50 and the emergency operation activation switch 80 constitute a pilot pressure switching unit for switching the pilot circuit between an on-loading state and an unloading state.

The operation lever 42 converts an operation direction and an operation amount into an operation electric signal, and outputs the operation electric signal to the controller 43. The controller 43 receives the operation electric signal of the operation lever 42 and outputs a drive electric signal to the corresponding electromagnetic proportional valve 44. The electromagnetic proportional valve 44 receives the drive electric signal from the controller 43, generates a pilot pressure proportional to the drive electric signal, and supplies the pilot pressure to the control valve 45. The pilot pressure unloading solenoid valve 50 supplies an electromagnetic proportional valve supply pressure from a pilot pressure source 51 to the electromagnetic proportional valves 44 and 44 via a pilot oil passage 82.

As illustrated in FIG. 1, the two electromagnetic proportional valves 44 are disposed corresponding to a driving direction of the actuator 47. To each of the electromagnetic proportional valves 44, a drive electric signal is output from the controller 43. The electromagnetic proportional valve 44 has a detent-type emergency manual operation function and includes, for example, an emergency operation screw as a manual operation unit. During an emergency operation, by directly operating an emergency operation unit, an operator can compulsorily open an oil passage of the electromagnetic proportional valve 44. As a result, a pilot pressure is supplied to the control valve 45.

A driving direction of the control valve 45 is switched by the pilot pressure from the electromagnetic proportional valve 44, and the control valve 45 controls a pressure oil from the hydraulic pump 46 and supplies the pressure oil to the actuator 47. As illustrated in FIG. 1, a variable capacity pump is adopted as the hydraulic pump 46. As described later, the hydraulic pump 46 is controlled such that a discharge amount during an emergency operation is smaller than that in a normal state.

Note that an actual construction machine includes a plurality of actuators, and includes a control valve and an electromagnetic proportional valve corresponding to each of the actuators. In FIG. 1, only one actuator 47 is illustrated in order to simplify description of an operation during an emergency operation.

As illustrated in FIG. 1, in a normal state, an energization state of the pilot pressure unloading solenoid valve 50 is switched by a drive electric signal from the controller 43. That is, when the operation lever 42 is in a neutral state, the pilot pressure unloading solenoid valve 50 is not energized by the controller 43. At this time, a tank port of the pilot pressure unloading solenoid valve 50 and an output port communicate with each other, and the pilot oil passage 82 is connected to a tank. As a result, the pilot circuit is in an unloading state.

Meanwhile, when the operation lever 42 is operated, the pilot pressure unloading solenoid valve 50 is energized by the controller 43. At this time, a supply port and the output port of the pilot pressure unloading solenoid valve 50 communicate with each other, and the pilot oil passage 82 is connected to the pilot pressure source 51. As a result, the pilot circuit is in an on-loading state. That is, an electromagnetic proportional valve supply pressure is supplied to the electromagnetic proportional valve 44 via the pilot oil passage 82.

The pressure-compensated flow regulating valve 52 is interposed between a pump oil passage 53 and a tank oil passage 54 and controls a flow rate of a flowing working oil. The relief valve 55 is interposed between the pump oil passage 53 and the tank oil passage 54 and operates when an oil pressure exceeds a set pressure to prevent an abnormal rise in pressure.

Figure 2:
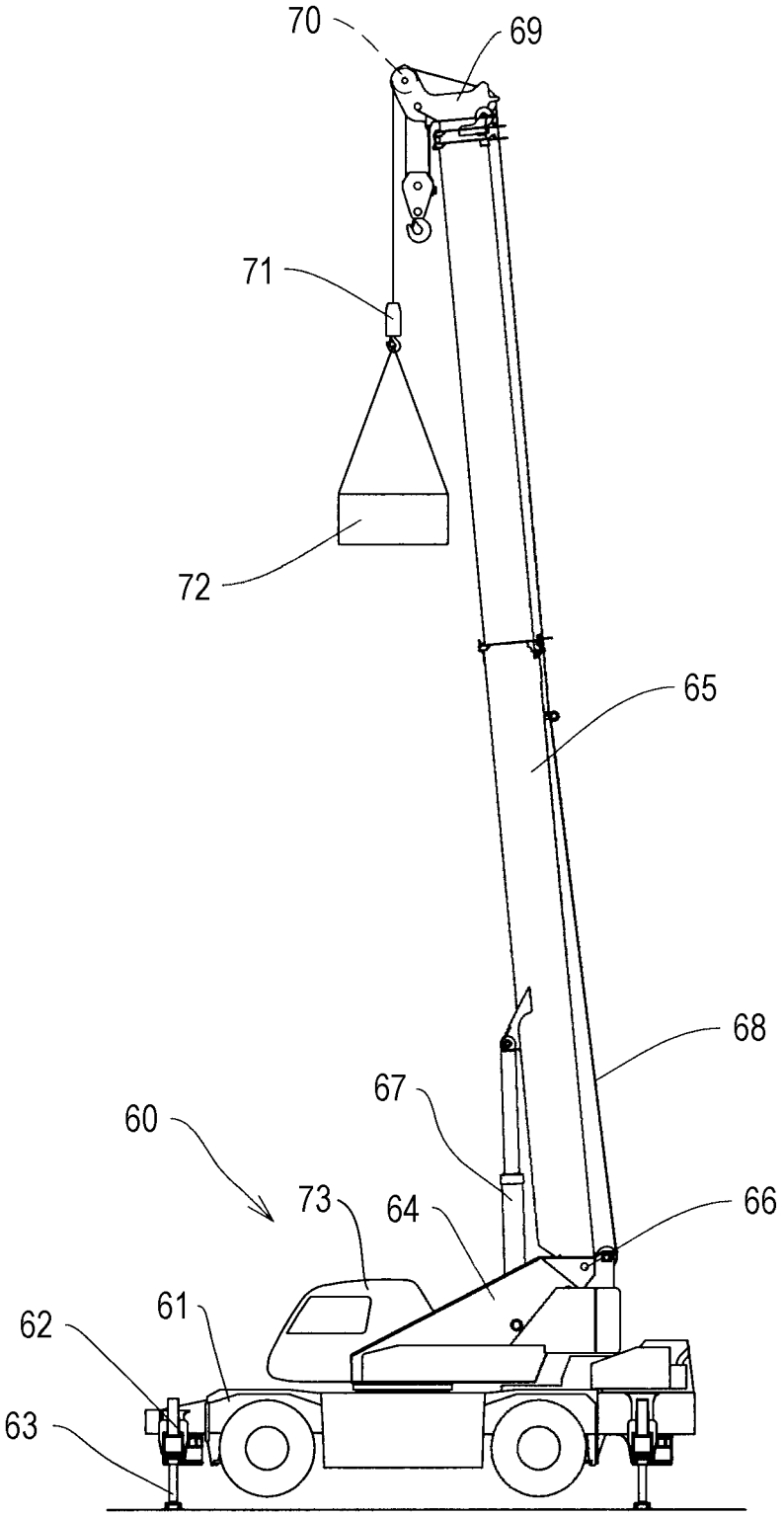
FIG. 2 is a diagram illustrating an example of a mobile crane on which the hydraulic system according to the embodiment is mounted.

FIG. 2 is a diagram illustrating an example of a mobile crane 60 on which the above-described hydraulic system 41 is mounted. In FIG. 2, the mobile crane 60 is in a crane working posture in which a jack cylinder 63 of an outrigger 62 disposed at the front and rear of a lower frame 61 extends, and the whole of the mobile crane 60 is jacked up.

A revolving frame 64 is mounted on an upper surface of the lower frame 61. The revolving frame 64 is freely rotatable with respect to the lower frame 61. A telescopic boom 65 is connected to the revolving frame 64 by a pin 66.

The telescopic boom 65 is freely raised or lowered with respect to the revolving frame 64. The telescopic boom 65 is expanded or contracted by a telescopic cylinder disposed therein. The telescopic boom 65 is raised or lowered by a derricking cylinder 67 interposed between the revolving frame 64 and the telescopic boom 65.

A wire rope 68 is unreeled from a winch (not illustrated) disposed in the revolving frame 64 and led to a telescopic boom distal end 69 along a rear surface of the telescopic boom 65. Furthermore, the wire rope 68 is stretched around a sheave 70 of the telescopic boom distal end 69, and a hook 71 is hung from a distal end of the wire rope 68. A hanging load 72 is hung from the hook 71.

In the mobile crane 60, it is assumed that an electromagnetic proportional valve (electromagnetic proportional valve for contracting the derricking cylinder 67) on a lower side of the derricking cylinder 67 suddenly stops operating by adhesion due to disconnection or contamination during work with the crane. Even in this situation, it is possible to lower the hanging load 72 downward by winding down the winch. However, in the crane posture illustrated in FIG. 2, the hanging load 72 hits a cab 73. In addition, it is dangerous to leave the hanging load 72 while the hanging load 72 is hung. Therefore, it is necessary to lower the derricking cylinder 67 by an emergency operation to lower the hanging load 72 to the ground.

Figure 3:
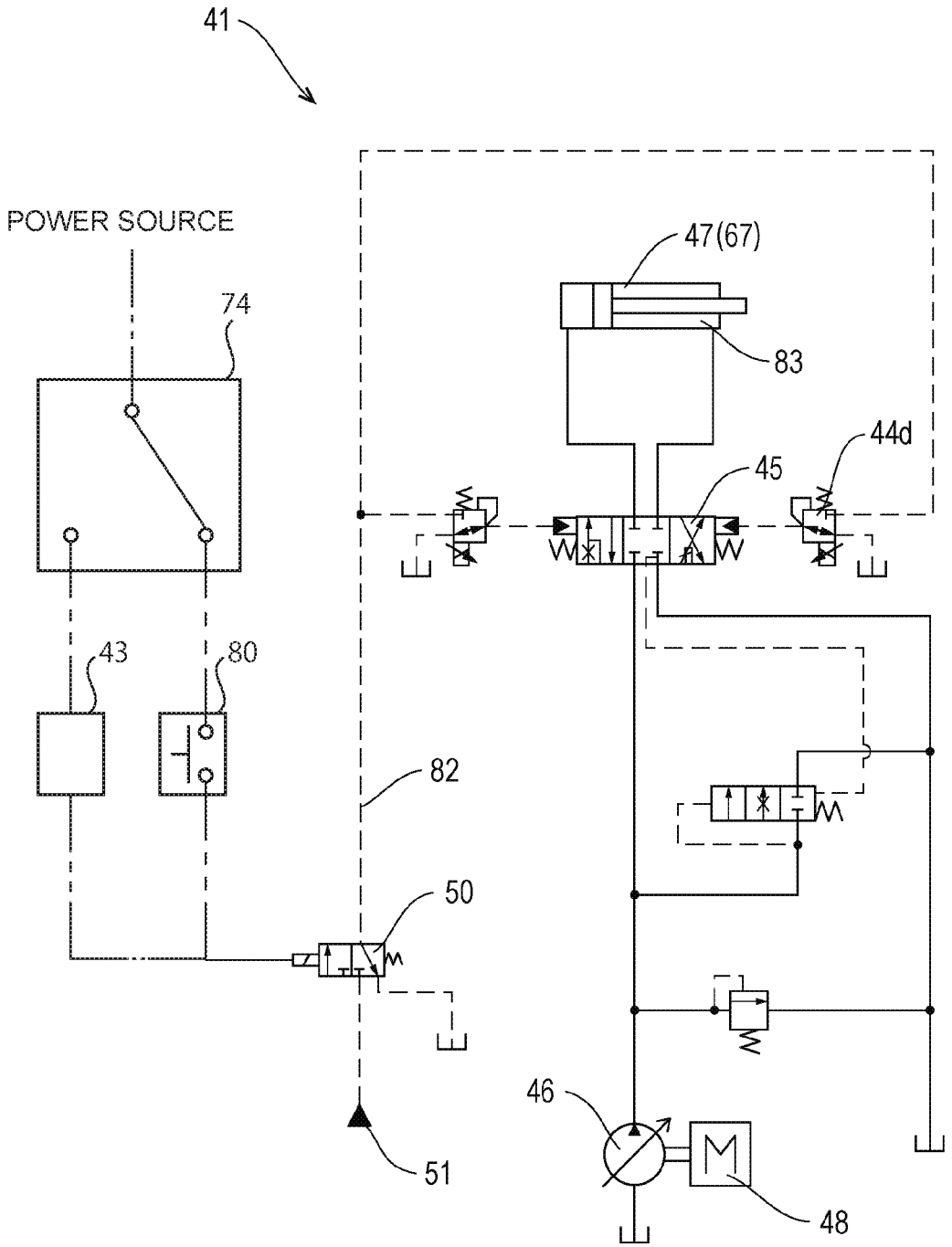
FIG. 3 is a diagram illustrating an example of a hydraulic circuit during an emergency operation of the hydraulic system.

FIG. 3 is a diagram illustrating an example of a hydraulic circuit during an emergency operation of the hydraulic system 41. By operation of an emergency operation selection switch 74 (see FIG. 5) disposed in the cab 73, the hydraulic system 41 is switched from a hydraulic circuit in a normal state (see FIG. 1) to a hydraulic circuit during an emergency operation (see FIG. 3).

Note that a detent-type switch is used as the emergency operation selection switch 74. That is, in the hydraulic system 41, when the emergency operation selection switch 74 is operated, the hydraulic circuit during an emergency operation is held.

As illustrated in FIG. 3, in the hydraulic system 41, an energization state of the pilot pressure unloading solenoid valve 50 is switched by the emergency operation activation switch 80 (see FIG. 5) instead of the controller 43 (see FIG. 1).

That is, the emergency operation activation switch 80 is used by an operator in a case where the controller 43 cannot control the electromagnetic proportional valve 44. The emergency operation activation switch 80 is disposed in the cab 73. The emergency operation activation switch 80 is disposed on a front operation panel of the cab 73 so as to be easily operated.

Note that a momentary type switch is used for the emergency operation activation switch 80. That is, only when the emergency operation activation switch 80 is operated, the pilot pressure unloading solenoid valve 50 is energized, and the pilot circuit is in an on-loading state.

An emergency operation of the hydraulic system 41 is performed in the following procedure. Here, a case where the derricking cylinder 67 is lowered by the emergency operation will be described.

First, by operation of the emergency operation selection switch 74 in the cab 73, an operator switches the hydraulic system 41 from a hydraulic circuit in a normal state (see FIG. 1) to a hydraulic circuit during an emergency operation (see FIG. 3). The controller 43 is thereby electrically cut off from the hydraulic system 41.

At this time, with the operation of the emergency operation selection switch 74, the discharge amount of the hydraulic pump 46 is switched to a small amount side. That is, the hydraulic pump 46 makes the supply amount of a working oil during an emergency operation during which the electromagnetic proportional valve 44 is manually opened smaller than the supply amount of the working oil in a normal state during which the electromagnetic proportional valve 44 is controlled by the controller 43.

Figure 4:
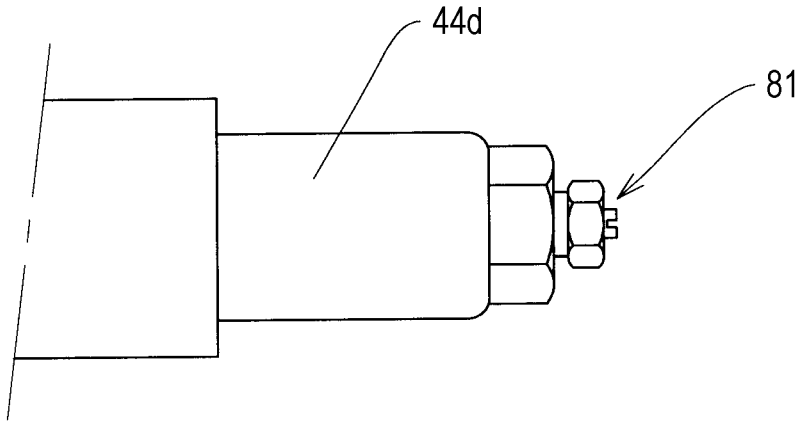
FIG. 4 is a diagram illustrating a main part of an electromagnetic proportional valve with a detent-type emergency manual operation function.

Next, the operator opens an electromagnetic proportional valve 44*d* on a lower side of the derricking cylinder 67 by an emergency manual operation function. FIG. 4 illustrates the electromagnetic proportional valve 44*d* including an emergency operation screw 81 as an example of an electromagnetic proportional valve with a detent-type emergency manual operation function. By directly operating the emergency operation screw 81, the operator can fix an oil passage in the electromagnetic proportional valve 44*d* in an opened state. The electromagnetic proportional valve 44*d* is disposed on the revolving frame 64. Therefore, the operator needs to come out of the cab 73 to the revolving frame 64 and to perform a detent operation (manually opening operation).

At this time, the pilot pressure unloading solenoid valve 50 is in a non-energization state because the emergency operation activation switch 80 is not operated, and is on a cutoff side (a state in which an output port and a tank port communicate with each other). Therefore, an electromagnetic proportional valve supply pressure of the pilot pressure source 51 has not come to the electromagnetic proportional valve 44*d*. That is, the pilot circuit is in an unloading state. Therefore, even if the operator directly performs the detent operation of the electromagnetic proportional valve 44*d* on the revolving frame 64, the control valve 45 is not switched, and the derricking cylinder 67 does not move to a lowering side. Therefore, the operator's safety is secured.

Next, the operator returns to the cab 73 and operates the emergency operation activation switch 80. Then, the pilot pressure unloading solenoid valve 50 is energized from a power source via the emergency operation activation switch 80. The pilot pressure unloading solenoid valve 50 is switched to a communication side (state in which the output port and the supply port communicate with each other), and the pilot circuit is in an on-loading state. As a result, an electromagnetic proportional valve supply pressure of the pilot pressure source 51 is applied to the electromagnetic proportional valve 44*d* on a lower side via the pilot oil passage 82.

A flow path of the electromagnetic proportional valve 44*d* on a lower side has already been manually opened. Therefore, the electromagnetic proportional valve supply pressure directly acts on the control valve 45 to switch the control valve 45 to a lower side. Then, a working oil discharged from the hydraulic pump 46 enters a contracting side oil chamber 83 of the derricking cylinder 67 via the control valve 45, and the derricking cylinder 67 starts a contracting operation. At this time, the discharge amount of the hydraulic pump 46 is switched to a small amount side, and the contracting operation of the derricking cylinder 67 is performed at a low speed. Therefore, the derricking cylinder 67 can be safely driven.

In the mobile crane 60, when the derricking cylinder 67 contracts, the telescopic boom 65 falls. An operator operates the emergency operation activation switch 80 until the hanging load 72 is sufficiently away from the cab 73 or an upper portion of the lower frame 61 to make the telescopic boom 65 fall. Thereafter, the operator returns the emergency operation screw 81 of the electromagnetic proportional valve 44*d* to close the oil passage. Then, by returning the emergency operation selection switch 74 in the cab 73 to a normal side and lowering a winch that can be operated normally, the hanging load 72 can be lowered to the ground.

That is, during an emergency operation, the operator controls the pilot circuit such that the pilot circuit is in an unloading state, and then manually opens the electromagnetic proportional valve 44*d* corresponding to a desired moving direction of the actuator 47. Thereafter, by operation of the emergency operation activation switch 80 in the cab 73 of the crane, the pilot pressure unloading solenoid valve 50 is controlled such that the pilot circuit is in an on-loading state, a pilot pressure is applied to the control valve 45, and the control valve 45 is thereby switched. As a result, the working oil of the hydraulic pump 46 is supplied to the actuator 47 to drive the actuator 47 in the desired moving direction.

As described above, the hydraulic system 41 according to the embodiment includes the hydraulic pump 46, the control valve 45 for supplying an operating pressure from the hydraulic pump 46 to the actuator 47 of a working machine, and an electric operation system (pilot pressure supply unit) for supplying a pilot pressure to the control valve 45. The electric operation system includes: the electromagnetic proportional valve 44 that has a detent-type emergency manual operation function with which the pilot oil passage 82 can be opened manually and generates a pilot pressure for the control valve 45; the controller 43 for controlling the degree of opening of the electromagnetic proportional valve 44 in accordance with an operation of an operation lever 42; and the pilot pressure switching unit for switching an oil pressure state of the pilot pressure supply unit between an on-loading state and an unloading state. The pilot pressure switching unit controls a pilot pressure such that the pilot pressure is in an unloading state when the electromagnetic proportional valve 44 is manually opened, and controls the pilot pressure such that the pilot pressure is in an on-loading state after the electromagnetic proportional valve 44 is manually opened.

Specifically, the pilot pressure switching unit includes: the pilot pressure unloading solenoid valve 50 for switching a pilot pressure between an on-loading state and an unloading state by energization; and the emergency operation activation switch 80 that is activated in a case where the electromagnetic proportional valve 44 cannot be controlled by the controller 43 and controls an energization state of the pilot pressure unloading solenoid valve 50.

With the hydraulic system 41 according to the present embodiment, an operator can safely perform work during an emergency operation even in a case where the electromagnetic proportional valve 44 itself has failed and does not operate by adhesion due to disconnection or contamination. Therefore, safety of a working machine is remarkably improved.

Hereinabove, the invention achieved by the present inventor has been specifically described based on the embodiment. However, the present invention is not limited to the above embodiment, and can be modified within a range not departing from the gist thereof.

For example, in the embodiment, the hydraulic system for driving the actuator 47 (derricking cylinder 67) of the mobile crane has been described. However, the present invention can also be applied to a hydraulic system of another actuator (for example, a telescopic cylinder). In addition, the present invention can also be applied to a hydraulic system of a working machine other than a mobile crane.

It should be considered that the embodiment disclosed here is illustrative in all respects and not restrictive. The scope of the present invention is defined not by the above description but by the claims and intends to include all modifications within meaning and scope equivalent to the claims.

REFERENCE SIGNS LIST

41 Hydraulic system
42 Operation lever
43 Controller
44 Electromagnetic proportional valve
45 Control valve
46 Hydraulic pump
47 Actuator
50 Pilot pressure unloading solenoid valve (pilot pressure switching unit)
80 Emergency operation activation switch (pilot pressure switching unit)

The invention claimed is:

1. A hydraulic system comprising: a hydraulic pump; a control valve for supplying an operating pressure from the hydraulic pump to an actuator of a working machine; and a pilot pressure supply unit for supplying a pilot pressure to the control valve, wherein the pilot pressure supply unit includes:

an electromagnetic proportional valve that has a detent-type emergency manual operation function capable of manually opening a pilot oil passage and generates the pilot pressure to the control valve;

a controller for controlling a degree of opening of the electromagnetic proportional valve in accordance with an operation of an operation lever; and a pilot pressure switching unit that switches the electromagnetic proportional valve between an on-loading state and an unloading state based on control of the controller or an operation of an operator; and an emergency operation selection switch that switches a power supply system to the pilot pressure switching unit between a first control system in a normal state and a second control system during an emergency operation based on an operation of the operator.

2. The hydraulic system according to claim 1, wherein the pilot pressure switching unit includes:

a pilot pressure unloading solenoid valve for switching the electromagnetic proportional valve between the on-loading state and the unloading state; and an emergency operation activation switch that is provided in the second control system to manually control an energization state of the pilot pressure unloading solenoid valve.

3. The hydraulic system according to claim 2, wherein the emergency operation activation switch is a momentary type switch.

4. The hydraulic system according to claim 2, wherein the emergency operation activation switch is disposed in a cab of the working machine.

5. The hydraulic system according to claim 1, wherein the hydraulic pump makes a supply amount of a working oil during the emergency operation smaller than a supply amount of the working oil in the normal state in accordance with the switching of the emergency operation selection switch.

* * * * *